US006734863B1

(12) United States Patent
Ikeda

(10) Patent No.: US 6,734,863 B1
(45) Date of Patent: May 11, 2004

(54) DISPLAY CONTROLLER FOR DISPLAY APPARATUS

(75) Inventor: Takashi Ikeda, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/538,985

(22) Filed: Mar. 30, 2000

(30) Foreign Application Priority Data

Mar. 31, 1999 (JP) ..... 11-091367

(51) Int. Cl.[7] ..... G09G 5/39

(52) U.S. Cl. ..... 345/531; 345/503; 345/545; 345/561

(58) Field of Search ..... 345/503, 520, 345/531, 535, 545, 556, 561

(56) References Cited

U.S. PATENT DOCUMENTS

| | | | | | |
|---|---|---|---|---|---|
| 4,695,838 | A | * | 9/1987 | Ellis, Jr. | 345/68 |
| 4,958,378 | A | * | 9/1990 | Bell | 382/222 |
| 5,061,919 | A | * | 10/1991 | Watkins | 345/806 |
| 5,241,625 | A | * | 8/1993 | Epard et al. | 345/502 |
| 5,446,840 | A | * | 8/1995 | Kiuchi et al. | 345/545 |
| 5,526,025 | A | * | 6/1996 | Selwan et al. | 345/556 |
| 5,831,639 | A | * | 11/1998 | Conticello | 345/556 |
| 5,835,086 | A | * | 11/1998 | Bradstreet et al. | 345/581 |
| 5,907,329 | A | | 5/1999 | Nobutani et al. | 345/511 |
| 5,990,852 | A | * | 11/1999 | Szamrej | 345/2.1 |
| 6,075,523 | A | * | 6/2000 | Simmers | 345/555 |
| 6,097,379 | A | * | 8/2000 | Ichiraku | 345/213 |
| 6,209,063 | B1 | * | 3/2001 | Kempf | 711/135 |
| 6,359,625 | B1 | * | 3/2002 | Perego | 345/555 |

FOREIGN PATENT DOCUMENTS

| | | |
|---|---|---|
| JP | 61-121086 | 6/1986 |
| JP | 63-63094 | 3/1988 |
| JP | 1-241599 | 9/1989 |
| JP | 2-120790 | 5/1990 |
| JP | 2-120791 | 5/1990 |
| JP | 2-217893 | 8/1990 |
| JP | 5-323906 | 12/1993 |
| JP | 8-248391 | 9/1996 |
| JP | 9-258168 | 10/1997 |
| JP | 10-11034 | 1/1998 |
| JP | 10-143123 | 5/1998 |

* cited by examiner

*Primary Examiner*—Ulka J. Chauhan
(74) *Attorney, Agent, or Firm*—Foley & Lardner

(57) ABSTRACT

A display controller for a display apparatus having a memory function which can reduce power consumption efficiently is disclosed. A rewriting comparison circuit detects whether or not rewriting of different data by a graphic engine since the last display updating by a reflect control circuit, and stores resulting information into a TagRAM. The refresh control circuit checks the address of the TagRAM prior to the updating of the display and, only when the data at a corresponding address of a VRAM has been rewritten since the last display updating, the refresh control circuit performs reading in of the data from the VRAM and signaling of the data to the display apparatus having a memory function.

9 Claims, 21 Drawing Sheets

DISPLAY CONTROLLER FOR DISPLAY APPARATUS

BACKGROUND OF THE INVENTION

1. Field of the Invention

The present invention relates to a display controller for controlling a display apparatus used as a display apparatus for an electronic apparatus such as a personal computer and having a memory function such as a ferroelectric liquid crystal display apparatus or a liquid crystal display apparatus with a display data storage function, and more particularly to a technique for reduction of power consumption of an entire display system including a display apparatus and a display controller of the type mentioned.

2. Description of the Related Art

Conventionally, display apparatus having a memory function such as a ferroelectric liquid crystal display apparatus disclosed in Japanese Patent Laid-Open No. Hei 63-063094 and a liquid crystal display apparatus with a display data storage circuit disclosed in Japanese Patent Laid-Open No. Hei 9-258168 are known as display apparatus of low power consumption for use with an electronic apparatus such as a personal computer. Where a display apparatus having a memory function is used, a variation in display data must be detected in order to make the most of the characteristic of the display apparatus of the type that data thereon should be rewritten only for those pixels with which data to be displayed are varied. Conventionally, for the detection of such variation of data (such detection is hereinafter referred to as rewriting detection), generally two methods described below are used.

In a first one of the methods, display data outputted from a display controller having no writing detection function are passed through a display conversion apparatus having a writing detection function to drive a display apparatus having a memory function. The method is disclosed in Japanese Patent Laid-Open No. Hei 10-11034.

FIG. 19 shows an apparatus which employs the first method. Referring to FIG. 19, a display conversion apparatus 81 connected to a display controller 79 which has no rewriting detection function includes a frame buffer 82 for temporarily storing display data for one screen (one frame), and a difference detection and display control circuit 83 for detecting a finite difference between two sets of display data and signaling only necessary display data at a timing requested by a display apparatus 3 having a memory function to the display apparatus 3. The display controller 79 outputs display data for the current screen as a display data signal 84, and the frame buffer 82 stores the display data. Simultaneously, the frame buffer 82 outputs display,data for the last screen as another display data signal 85. The difference detection and display control circuit 83 compares the display data signal 84 and the display data signal 86 with each other and outputs, when the display data signal 84 and the display data signal 85 are different from each other, a display data signal 86 to the display apparatus 3.

FIG. 20 shows the display controller 79 and elements associated with the display controller 79. Referring to FIG. 20, the display controller 79 includes a graphic engine 6 for producing display data based on a plotting instruction and plotting data 11 from a host CPU 1 and writing the display data into a video memory (hereinafter referred to simply as VRAM) 4, a refresh control circuit 10 for reading out the display data from the VRAM 4 in a fixed period and signaling the display data to a display apparatus 80, and a VRAM arbitration circuit 8 for arbitrating a VRAM access right between the graphic engine 6 and the refresh control circuit 10. It is to be noted that reference numeral 14 denotes an internal VRAM enabling signal, 15 a VRAM control signal set, 16 a VRAM data signal set, 19 a VRAM request signal, 23 a display control signal set, 24 an updating signal, 25 a memory clock signal, and 26 a display clock signal.

The second method corresponds to an arrangement wherein the display controller 79 shown in FIG. 20 has an internal function for detecting write accessing of the graphic engine 6 to the VRAM 4 (refer to Japanese Patent Laid-Open No. Hei 8-248391).

FIG. 21 shows an apparatus which employs the second method. Referring to FIG. 21, if a writing detection circuit 88 in a display controller 87 for a display apparatus having a memory function detects write accessing of a graphic engine 6 to a VRAM 4 through supervision of a VRAM bus 91, then it discriminates from a write address of the write accessing to which scanning line on the display apparatus 3 the write accessing is directed. Then, the writing detection circuit 88 sends an updating flag signal 90 to the display control circuit 89 to deliver the number of the scanning line and information that rewriting of display data has occurred. Based on the information, the display control circuit 89 signals a display data signal 92 representative of display data only for the scanning line, for which the display data has been rewritten, to the display apparatus 3.

The conventional rewriting detection methods described above, however, have the following problems.

With the first method, a frame buffer having an equal memory capacity to that of a VRAM must be provided separately from the VRAM. This increases the number of parts and the cost Further, in order to allow display data to be displayed, both of the VRAM and the frame buffer must be accessed, which gives rise to a problem of an increase of power consumption.

With the second method, since rewriting detection is detection of mere write accessing and no attention is paid to a variation of data, also an operation to "write data same as currently stored data" is discriminated as "rewritten" and rewriting also for pixels which need not be updated occurs. This results in failure in sufficiently exhibiting the advantage of a display apparatus having a memory function. In other words, the second method has a problem in that power consumption cannot be reduced efficiently.

SUMMARY OF THE INVENTION

It is an object of the present invention to provide a display controller for a display apparatus having a memory function which can reduce power consumption efficiently.

In order to attain the object described above, according to the present invention, there is provided a display controller for controlling a display apparatus having a memory function, comprising display updating apparatus for updating a display of the display apparatus, display data storage means, display data production means for producing and writing display data into the display data storage means, rewriting comparison means for detecting by comparison whether or not rewriting of data in a line, which is a set of pixels including a certain number of successive pixels on one scanning line of the display apparatus and is used as a unit of comparison, into the display data storage means has occurred, rewriting information storage means for storing comparison information of a result of the comparison of the rewriting comparison means into a corresponding address thereof, and rewriting control means for checking, prior to updating of the display by the display updating means, the address of the writing information storage means and, only when stored contents of the address represent rewriting of different data, reading the data from the display data storage means and signaling the data to the display apparatus through the display updating means.

Since the display apparatus having a display function has a characteristic that it requires updating of a display only for pixels whose display data vary, updating of the display of the display apparatus is performed periodically (for example, several tens times/second or more) by the display updating means. On the other hand, it is detected by the rewriting comparison means whether or not rewriting of different data by the display data production means for a line of those pixels with regard to which updating of the display is to be performed currently has occurred since the last display updating, and resulting information is stored into the rewriting information storage means. The rewriting control means checks the address of the display data storage means prior to the updating of the display and, only when the data at the address of the display data storage means has been rewritten since the last display updating, the rewriting control means performs reading in of the data from the display data storage means and signaling of the data to the display apparatus having a memory function.

The display data storage means may include the rewriting comparison means for detecting by comparison whether or not rewriting of data has occurred. In this instance, the rewriting comparison means may latch and compare potentials to detect whether or not rewriting of data has occurred.

The display controller may further comprise arbitration means for arbitrating accessing of the display data production means to the display data storage means and accessing of the rewriting comparison means to the rewriting information storage means.

The display controller may further comprise line size variation means for varying the number of pixels which form a line as the unit of rewriting comparison.

The display controller for a display apparatus having a memory construction is advantageous in that the power consumption of the display apparatus having a memory function and the display data storage means can be reduced. This is because accessing to the display apparatus and the display data storage means which occurs in order to display an image is required only for each line which includes pixels with regard to which display data have varied. On the other hand, accessing to the rewriting information storage means is required. However, the accessing frequency (which varies depending upon the size of the line) is reduced to one nth when compared with the accessing frequency to display data storage means in a conventional memory controller where n is the size of the line, and the comparison information requires only the smallest data width of one bit. Therefore, the increase of accessing caused by the accessing to the rewriting information storage means is much smaller than the decrease of accessing described above.

Where the display controller includes the line size variation means, the power consumption can be reduced more efficiently by increasing the line size when rewriting of the display occurs less frequency and decreasing the line size when rewriting of the display occurs comparatively frequently.

The display controller for a display apparatus having a memory function is advantageous also in augmentation of the performance of the display system. This is because the decrease of accessing to the display data storage means signifies an increase of the period within which the display data production means possesses an access right to the display data storage means and consequently the waiting time for accessing of the display data production means to the display data storage means decreases when compared with that in a conventional display controller.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENTS

Figure 1:
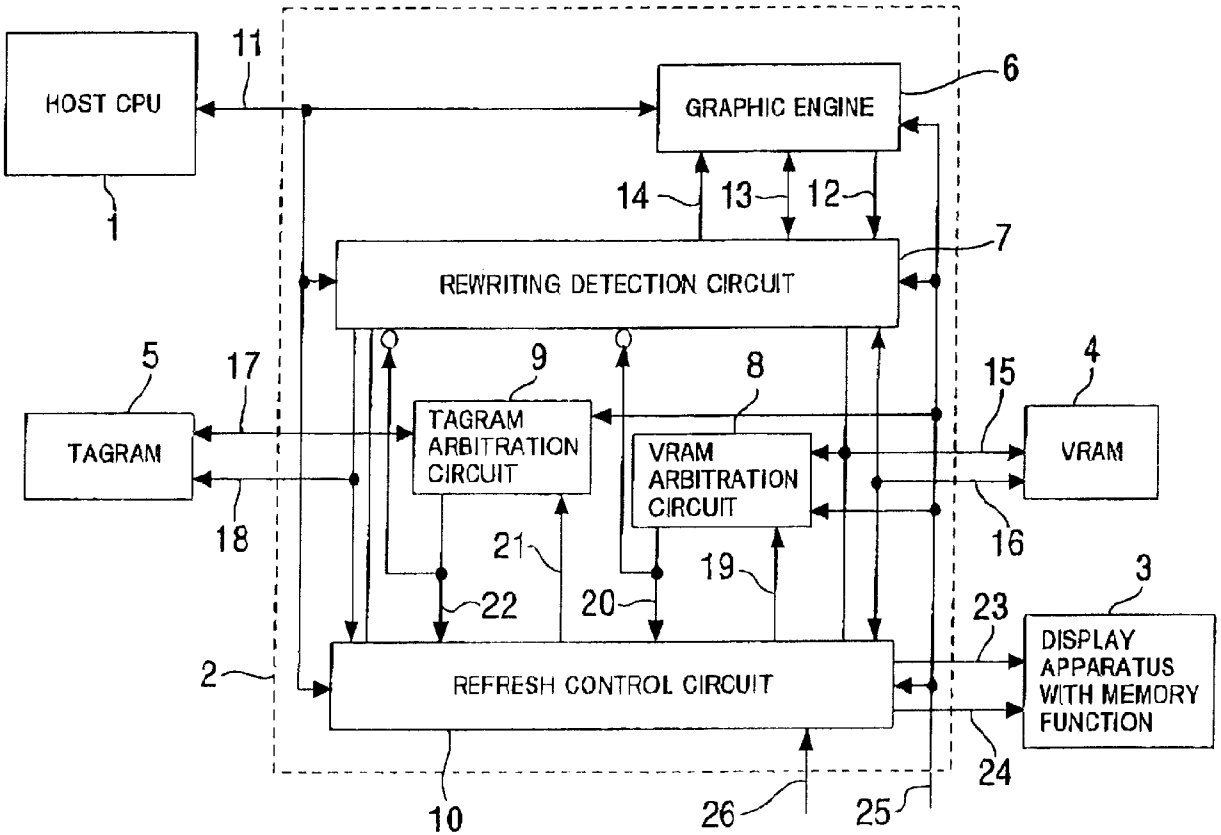
FIG. 1 is a block diagram of a system in which a display controller for a display apparatus having a memory function to which the present invention is applied is incorporated.

Referring to FIG. 1, there is shown a system in which a display controller for a display apparatus having a memory function is incorporated. The system shown includes a display controller 2 to which the present invention is applied, a host CPU 1 for issuing information of an image or instruction for image operations to the display controller 2 in accordance with commands of application software, an image memory (VRAM) 4 formed from a common DRAM (Dynamic Random Access Memory) for storing image data, a TagRAM 5 formed from a high speed SRAM (Static Random Access Memory) for storing information of whether data of the VRAM 4 is different from data in the preceding refresh, and a display apparatus 3 having a memory function for displaying an image.

The display controller 2 to which the present invention is applied includes a graphic engine 6 for converting instructions and information from the host CPU 1 into VRAM data, a rewriting detection circuit 7 for supervising accessing of the graphic engine 6 to the VRAM 4 and when data different from data currently stored in the VRAM 4 is to be written into the VRAM 4, writing the information representing this to the TagRAM 5, a refresh control circuit 10 for checking the TagRAM 5 in a period determined in advance and, when the data in the TagRAM 5 represents "updated", reading image data from the VRAM 4 at the corresponding address and transferring the image data to the display apparatus 3, a VRAM arbitration circuit 8 for arbitrating accessing to the VRAM 4 between the rewriting detection circuit 7 and the refresh control circuit 10, and a TagRAM arbitration circuit 9 for arbitrating accessing to the TagRAM 5 between the rewriting detection circuit 7 and the refresh control circuit 10.

The host CPU 1 is connected to the graphic engine 6, rewriting detection circuit 7 and refresh control circuit 10 over a host bus 11 so that it can set up the operation mode of them, for example the line size described below. The VRAM 4 is connected to the rewriting detection circuit 7 and the refresh control circuit 10 by a VRAM control signal set 15 and a VRAM data signal set 16 for exclusively controlling the rewriting detection circuit 7 and the refresh control circuit 10, respectively. The access right to the VRAM 4 is arbitrated by the VRAM arbitration circuit 8, and one of the rewriting detection circuit 7 and the refresh control circuit 10 which does not have the access right places the VRAM control signal set 15 and the VRAM data signal set 16 into a high impedance or inputting state.

The TagRAM 5 is connected to the rewriting detection circuit 7 and the refresh control circuit 10 by a TagRAM control signal set 17 and a TagRAM data signal 18 for exclusively controlling the rewriting detection circuit 7 and the refresh control circuit 10. The access right to the TagRAM 5 is arbitrated by the TagRAM arbitration circuit 9, and one of the rewriting detection circuit 7 and the refresh control circuit 10 which does not have the access right places the TagRAM control signal set 17 and the TagRAM data signal 18 into a high impedance or inputting state, The refresh control circuit 10 is connected to the display apparatus 3 by a display control signal set 23 (timings and data) and an updating signal 24.

In the inside of the display controller 2, the graphic engine 6 and the rewriting detection circuit 7 are connected by an internal VRAM control signal set 12, an internal VRAM data signal set 13 and an internal VRAM enabling signal 14. In particular, the internal VRAM control signal set 12 is outputted from the graphic engine 6; the internal VRAM data signal set 13 is bidirectionally transmitted so that it can be outputted from and inputted to the graphic engine 6; and the internal VRAM enabling signal 14 is inputted to the graphic engine 6.

The VRAM arbitration circuit 8 receives a VRAM requesting signal 19 outputted from the refresh control circuit 10 and outputs a VRAM enabling signal 20 to the rewriting detection circuit 7 and the refresh control circuit 10. The VRAM enabling signal 20 has opposite active levels to the refresh control circuit 10 and the rewriting detection circuit 7. In particular, when the VRAM enabling signal 20 is "1", it allows the refresh control circuit 10 to access the VRAM 4, but when the VRAM enabling signal 20 is "0", it allows the rewriting detection circuit 7 to access the VRAM 4.

Similarly, the TagRAM arbitration circuit 9 receives a TagRAM requesting signal 21 outputted from the refresh control circuit 10 and outputs a TagRAM enabling signal 22 to the rewriting detection circuit 7 and the refresh control circuit 10. The TagRAM requesting signal 21 has opposite active levels to the refresh control circuit 10 and the rewriting detection circuit 7 similarly.

To the display controller 2, a memory clock signal 25 and a display clock signal 26 are supplied as reference clock signals for operation. The memory clock signal 25 is distributed to all internal circuits of the display controller 2, but the display clock signal 26 is supplied only to the refresh control circuit 10.

Operation of the system shown in FIG. 1 is described now.

Of the internal circuits of the display controller 2, the graphic engine 6, rewriting detection circuit 7 and refresh control circuit 10 operate independently of each other. The rewriting detection circuit 7 and the refresh control circuit 10 share the VRAM 4 and the TAGRAM 5 and use the VRAM control signal set 15, VRAM data signal set 16, TagRAM control signal set 17 and TagRAM data signal 18 as common signals. Therefore, the VRAM arbitration circuit 8 and the TagRAM arbitration circuit 9 control to which one of the rewriting detection circuit 7 and the refresh control circuit 10 the access right to the VRAM or the TagRAM 5 should be given at a certain point of time.

First, operation of the refresh control circuit 10 is described with reference to FIG. 2 The signal H_SYN denotes one of signals of the display control signal set 23 and provides a display position on the display apparatus 3. Also D_DAT denotes a signal of the display control signal set 23 and provides one display gradation. M_ENB represents the updating signal 24 and controls the display apparatus 3 such that any pixel which corresponds to a period wherein M_ENB="0" does not update its display but maintains its current display. T_REQ represents the TagRAM requesting signal 21; T_ACK represents the TagRAM enabling signal 22; and T_ADR represents part of the TagRAM control signal set 17 and provides an address. T_DAT represents the TagRAM data signal 18; and T_WE# represents one of signals of the TagRAM control signal set 17 and controls writing into the TagRAM 5. M_REQ represents the VRAM requesting signal 19; M_ACK the VRAM enabling signal 20; M_A/C the VRAM control signal set 15; and M_DATA the VRAM data signal set 16.

Figure 2:
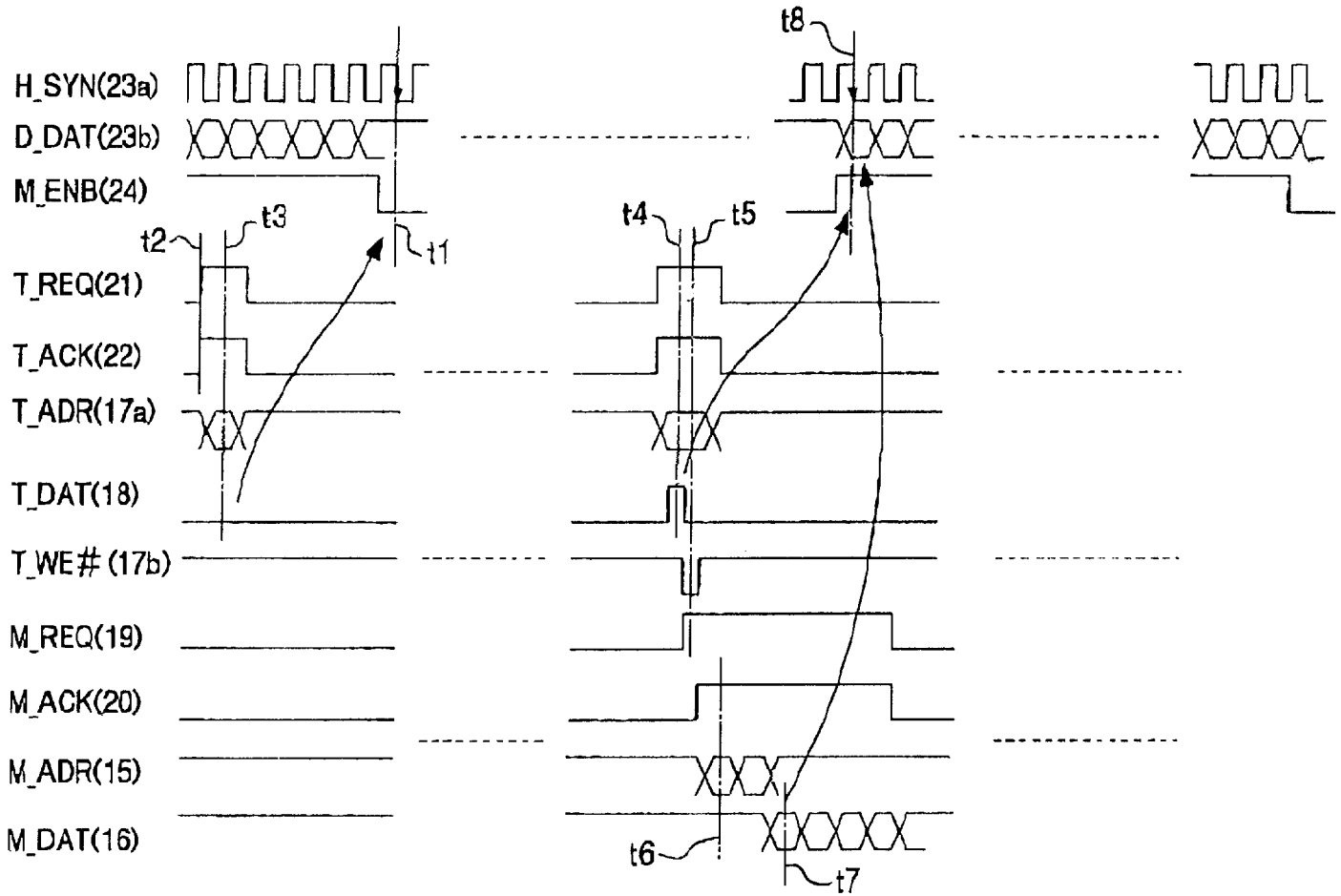
FIG. 2 is a timing chart illustrating operation of a refresh control circuit shown in FIG. 1.

Prior to transfer of display data to the display apparatus 3 which is started at a timing t1 in FIG. 2, in order to determine whether or not data at a corresponding address on the VRAM 4 has been rewritten, the refresh control circuit 10 issues an access request to the TagRAM 5 to the TagRAM arbitration circuit 9 at another timing t2. If the TagRAM arbitration circuit 9 discriminates through supervision of the TagRAM control signal set 17 that the rewriting detection circuit 7 is not accessing the TagRAM 5, then it returns a TagRAM enabling signal 22 immediately. The refresh control circuit 10 receives the TagRAM enabling signal 22 and outputs an address corresponding to a line (the line is hereinafter described) to be transferred from the timing t1 to the TagRAM 5. If the line has been updated, then the TagRAM 5 outputs "1" to the signal T_DAT, but if the line has not been updated, then the TagRAM 5 outputs "0".

At a timing t3 in FIG. 2, T_DAT is "0", which signifies that the line "has not been rewritten". Since accessing to the TagRAM 5 is completed in this stance, the refresh control circuit 10 releases the TagRAM requesting signal 21 (resets T_REC="0"). Based on the information that the line has not been rewritten, the refresh control circuit 10 does not issue an access request to the VRAM 4 (M_REQ="0" is maintained) and sets M_ENB to "0" to notify the display apparatus 3 that the display of the line need not been updated.

Similarly, prior to display data transfer from a timing t8, the refresh control circuit 10 checks the TagRAM 5 and discriminates from T_DAT="1" (at a timing t4) that the stored contents of the VRAM 4 for the line have been rewritten. Consequently, the refresh control circuit 10 issues an access request to the VRAM 4 to the VRAM arbitration circuit 8 (at a timing t5). Simultaneously, the refresh control circuit 10 outputs T_WE#="0" and T_DAT="0" to write "0" as data into the address of the TagRAM 5 to clear the TagRAM 5 and then releases the access request to the TagRAM 5 (T_REQ="0"). As the refresh control circuit 10 is given the access right to the VRAM 4 through M_ACK="1", it controls the VRAM control signal set 15 to start reading in of data from the VRAM 4 beginning with the pertaining address (at a timing t6). Then, the refresh control circuit 10 starts transfer of the data, which has read in to the display apparatus 3 through the VRAM data signal set 16, at a timing t7 through the display control signal set 23 (at a timing t8).

Now, operation of the graphic engine 6 and the rewriting detection circuit 7 is described with reference to FIG. 3.

The signal M_CLK represents the memory clock signal 25; and G_ADR is one of signals of the internal VRAM control signal set 12 and provides an address to the VRAM 4. C_COM is a signal of the internal VRAM control signal set 12 and provides a command to the VRAM 4. G_DAT represents the internal VRAM data signal set 13; and G_ENB represents the internal VRAM enabling signal 14. M_ADR is a signal of the VRAM control signal set 15 and provides an address. M_COM is a signal of the VRAM control signal set 15 and provides a command. The other common reference characters to those of FIG. 2 represent common signals to those of FIG. 2.

Figure 3:
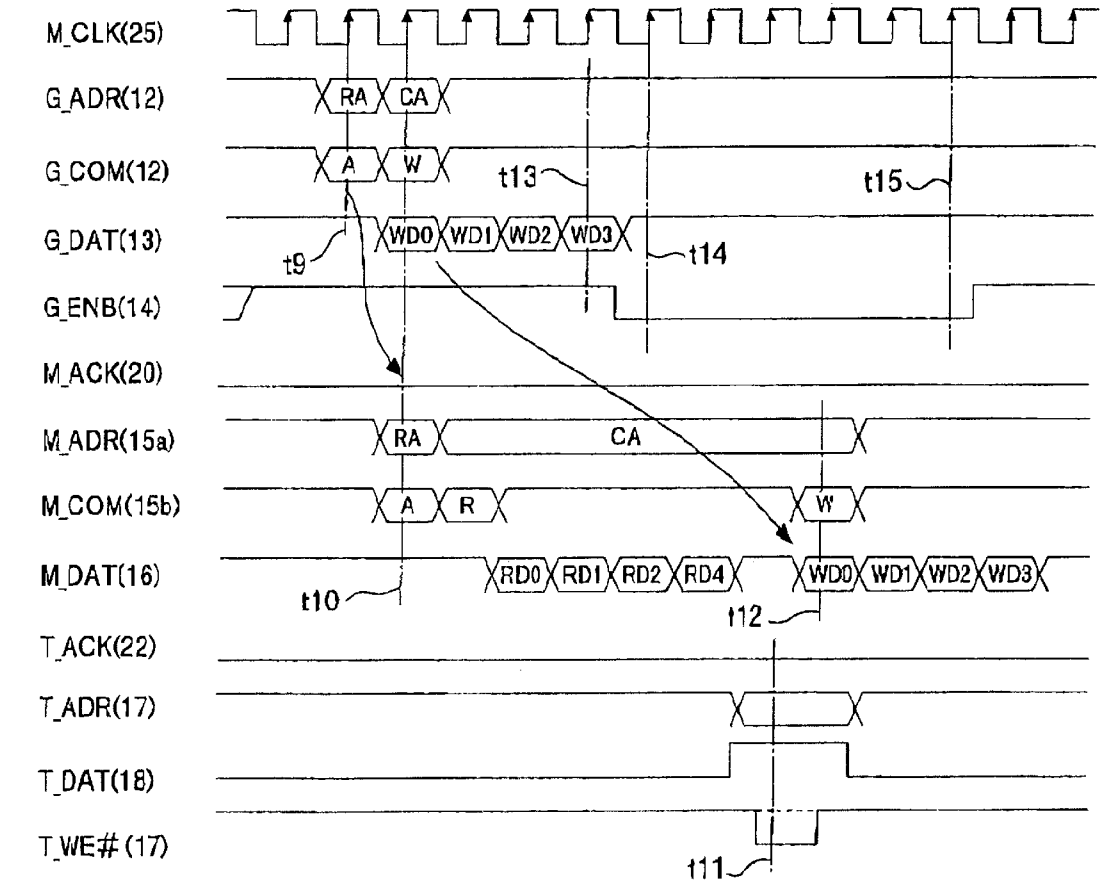
FIG. 3 is a timing chart illustrating operation of a graphic engine and a rewriting detection circuit shown in FIG. 1.

After the graphic engine 6 starts write accessing to the VRAM 4 at a timing t9 in FIG. 3, if M_ACK="0" then, then the rewriting detection circuit 7 receiving the write accessing first starts, at a timing t10 delayed by one memory clock, read accessing to the write address (RA, CA) of the VRAM 4 received formerly. Here, data (WD0 to WD3) outputted to the internal VRAM data signal set 13 from the graphic engine 6 beginning with the timing t10 are temporarily stored into a write buffer not shown in the rewriting detection circuit 7. Then, data (RD0 to RD3) outputted from the VRAM 4 to the VRAM data signal set 16 in response to the read accessing started at the timing t10 by the rewriting detection circuit 7 and the data (WD0 to WD3) stored in the write buffer in the rewriting detection circuit 7 are successively compared with each other. Then, if the data are partly different from each other, T_ACK="0" is confirmed, and the TagRAM address corresponded to the VRAM address is outputted to T_ADR; "1" is outputted to T_DAT; T-WE# is set to "0"; and "1" is written into the corresponding address of the TagRAM 5 (at a timing t11).

This makes information representing that the display data has a variation in the line. If the data WD0 to WD3 and RD0 to RD3 have no difference therebetween, then T_WE# in FIG. 3 remains to be "1" as indicated by a broken line, and writing into the TagRAM 5 is not performed. The rewriting detection circuit 7 starts a writing operation into the VRAM 4 of the write data temporarily stored in the write buffer at a timing t12 continuously to the read accessing described hereinabove.

Here, since the accessing of the graphic engine 6 is completed already at a timing t13 prior to the timing t12, the graphic engine 6 may possibly start next accessing at a next memory clock, that is, at a timing t14. Therefore, prior to the timing t14. G_ENB is reset to G_ENB="0" to inhibit VRAM accessing of the graphic engine 6 till a timing t15 at which the rewriting detection circuit 7 is prepared to VRAM accessing of the graphic engine 6.

A VRAM access request may possibly be generated by the refresh control circuit 10 during VRAM accessing of the rewriting detection circuit 7. What is important in this instance is only that a request from the refresh control circuit 10 basically takes precedence, and various variations are possible with regard to detailed operation itself of arbitration control in this instance. In the following, an example is described with reference to FIG. 4.

Figure 4:
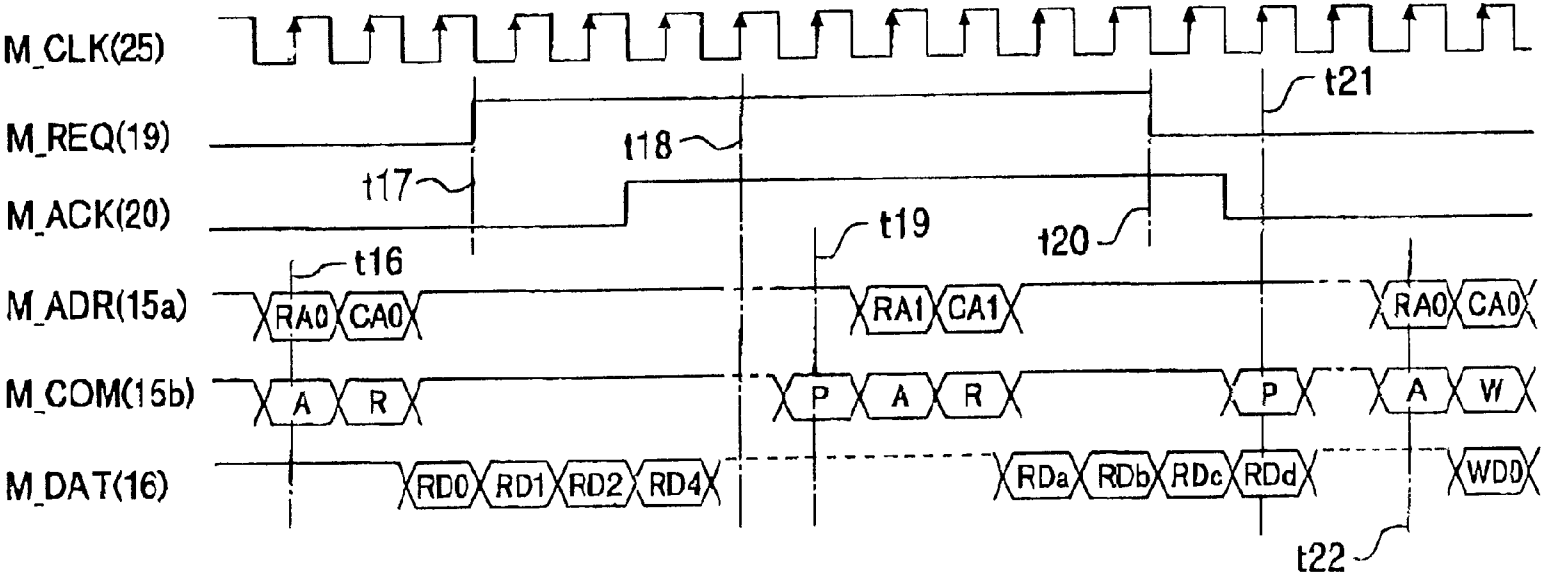
FIG. 4 is a timing chart illustrating operation of a VRAM mediation circuit and a TagRAM arbitration circuit shown in FIG. 1.

First at a timing t16 in FIG. 4, the rewriting detection circuit 7 starts read accessing to the VRAM 4 similarly as at the timing t10 in FIG. 3. If a VRAM access request is issued from the refresh control circuit 10 (M_REQ="1") during the read accessing (for example, at a timing t17), then the VRAM arbitration circuit 8 sets M_ACK to M_ACK="1" simultaneously with starting of reading in of the last data (RD4) to provide the access right to the refresh control circuit 10. The rewriting detection circuit 7 receives M_ACK="1" and temporarily reserves the write accessing which was started at the timing t12 in FIG. 3. Then, the rewriting detection circuit 7 places the VRAM control signal set 15 and the VRAM data signal set 16 into a high impedance or inputting state.

On the other hand, the refresh control circuit 10 which has acquired the access right first issues a precharge command (at a timing t19), then reads in data from a desired address, and issues a precharge command again simultaneously upon reading in of the last data (RD4) (at a timing t21). Further, the refresh control circuit 10 resets M_REQ to M_REQ="0" at a timing prior by one memory clock to this (at a timing t20). The VRAM arbitration circuit 8 receives M_REQ="0" and resets M_ACK to M_ACK="0" to give the access right to the VRAM 4 to the rewriting detection circuit 7. The rewriting detection circuit 7 thus acquiring the access right to the VRAM 4 again starts the write accessing, which has been temporarily reserved, at a timing t22. Until the write accessing is completed, the rewriting detection circuit 7 keeps the internal VRAM enabling signal 14 (G_ENB) equal to "0" to inhibit the graphic engine 6 from starting new VRAM accessing similarly as in the case described hereinabove with reference to FIG. 3.

Subsequently, the "line" mentioned hereinabove is described with reference to FIG. 5.

Figure 5:
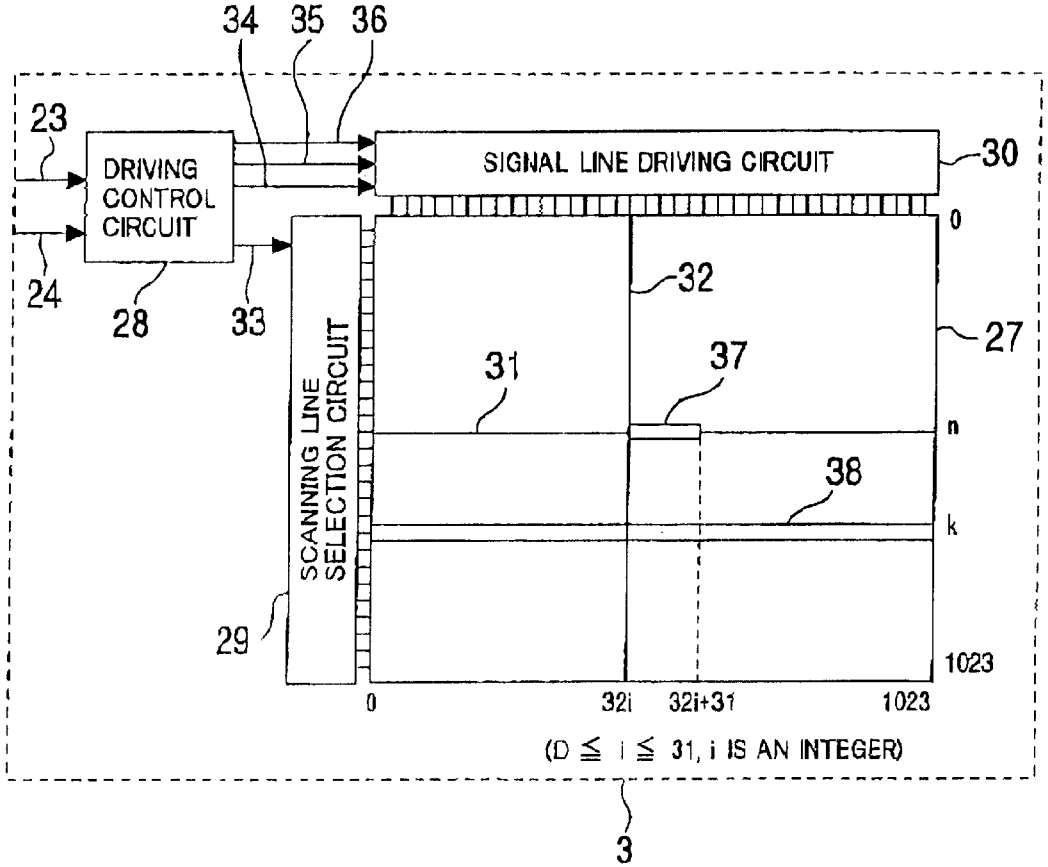
FIG. 5 is a block diagram showing an internal structure of a display apparatus having a memory function shown in FIG. 1.

FIG. 5 shows an internal structure of the display apparatus 3 having a memory function. The display apparatus 3 having a memory function shown includes a display unit 27 having a memory function for displaying an image, a scanning line selection circuit 29 for selecting and driving one of scanning lines 31 of the display unit 27, a signal line driving circuit 30 for driving signal lines 32 of the display unit 27, and a driving control circuit 28 for producing a scanning line synchronizing signal 33, a signal line data signal 34, a signal line synchronizing signal 35 and a display holding signal 36 for controlling the scanning line selection circuit 29 and the signal line driving circuit 30 from a display control signal set 23 and an updating signal 24 inputted thereto.

The scanning line selection circuit 29 selects and drives one of the scanning lines 31 which is to be currently selected from the scanning line synchronizing signal 33 outputted from the driving control circuit 28 using a shift register, a latch or the like. Meanwhile, the signal line driving circuit 30 produces a voltage to be applied to a signal line 32 based on the signal line synchronizing signal 35, signal line data signal 34 and display holding signal 36 outputted from the driving control circuit 28 using a shift register, a latch or the like and applies the voltage to the signal lines 32 in synchronism with driving of the scanning line 31.

The "line" in the present specification represents a set of successive pixels on a scanning line, and whether display data "has varied/not varied" is discriminated in a unit of a set of pixels. Consequently, where the set is small, there is an advantage that accessing of the refresh control circuit 10 to the VRAM 4 is required less frequently for a variation of an image within a small range, but there is a disadvantage that a greater capacity is required for the TagRAM 5 and the frequency of accessing of the refresh control circuit 10 to the TagRAM 5 increases.

On the contrary where the set is great, the capacity of the TagRAM 5 and the frequency of accessing of the refresh control circuit 10 to the TagRAM 5 may be low, but when a line for which updating of display is required is hit once, excessive accessing of the refresh control circuit 10 to the VRAM 4, that is, accessing which arises from a rule that display is updated also for those pixels within the same set even if display data for the pixels have not varied and which actually is not necessary, increases.

Figure 6:
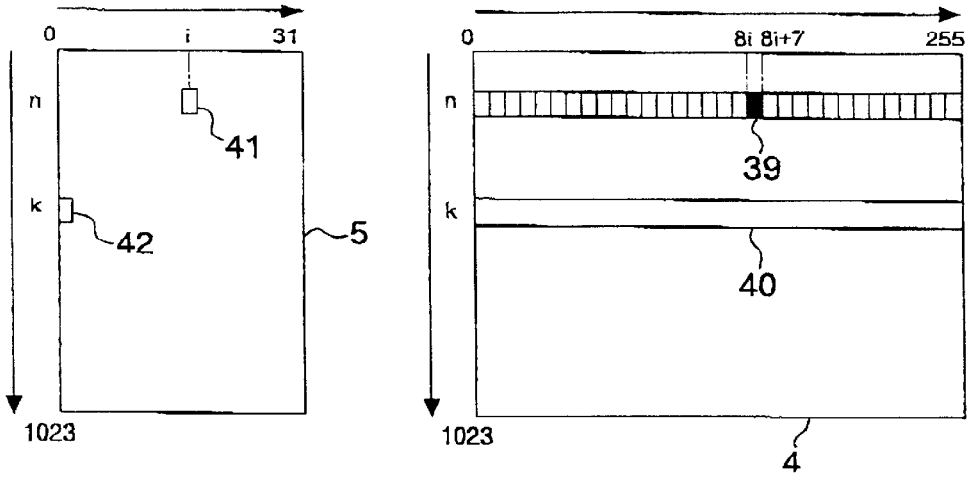
FIG. 6 is a diagrammatic view illustrating a concept of the VRAM and the TagRAM shown in FIG. 1.

Therefore, in the present embodiment, a variable line size is used, and the line size is varied by software or hardware so that power consumption can be reduced most efficiently in response to a variation situation of display data. For example, reference character 37 in FIG. 5 represents a line size wherein one line includes 32 pixels, and 38 represents another line size wherein one line includes all pixels on one scanning line. FIG. 6 illustrates a concept of the VRAM 4 and the TagRAM 5, and in FIG. 6, the VRAM 4 is shown having a size of 256 (columns)×1,024 (rows) corresponding to the display space of FIG. 5 which has a size of 1,024×1,024 pixels. In particular, an address space of 256 Kbits wherein one word of the VRAM 4 corresponds to four pixels is presumed (for example, a gradation of a pixel is represented by 16 bits and one word of the VRAM has 64 bits). In this instance, where the minimum pixel number of one line is 32, the TagRAM 5 is required to have an address space of 1,024/32×1,024=32 Kbits as seen from FIG. 6.

The 32-pixel line 37 of FIG. 5 includes 32 pixels driven by the 32ith to 32i+31st signal lines on the nth scanning line, and display data are stored in a memory block 39 from the 8ith column of nth row to the 8i+7th column of the nth row of the VRAM 4 shown in FIG. 6 while whether rewriting of data has occurred in the memory block 39 is stored in a memory portion 41 of the nth row of the ith column of the TagRAM 5.

On the other hand, where one line includes all pixels on one scanning line, for example, as denoted by 38 in FIG. 5, all pixels on the kth scanning line make components of one line, and display data for the line is stored in an entire memory block 40 of the kth row of the VRAM 4 shown in FIG. 6. Further, whether or not data on the memory block 40 has been rewritten is stored in a memory block 42 of the kth row of the 0th column of the TagRAM 5.

Figure 7:
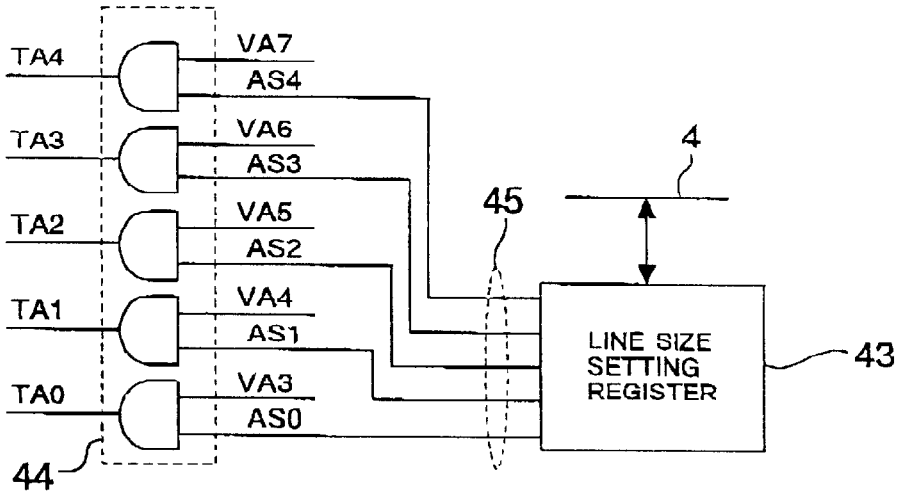
FIG. 7 is a diagrammatic view showing an address control circuit for the VRAM and the TagRAM shown in FIG. 1.

An example of a circuit for the control described above is shown in FIG. 7. Referring to FIG. 7, reference character VAx represents an address signal for the VRAM 4, and TAx represents an address signal for the TagRAM 5. Where the VRAM 4 has an address space of 256 Kbits, an address signal of 18 bits VA17 to VA0 is required. Where the TagRAM 5 has an address space of 32 Kbits, an address signal of 15 bits TA14 to TA0 is required. The ten high order bits VA17 to VA8 and TA14 to TA5 are connected directly to the VRAM 4 and the TagRAM 5, respectively. Meanwhile, the remaining bits TA4 to TA0 of the address signal for the TagRAM 5 are produced by AND gates 44 which logically AND the bits VA7 to VA3 of the address signal for the VRAM 4 with respective bits of an address selection signal 45 as seen from FIG. 7. The address selection signal 45 is connected to a line size setting register 43. The line size setting register 43 may set a line size in accordance with an instruction given thereto over the VRAM 4 by software or may alternatively set a line size automatically by hardware.

Operation of the circuit shown in FIG. 7 is described now.

First, where one line includes 32 pixels, the line size setting register 43 is set so that all bits AS0 to AS4 of the address selection signal 45 may be "1". Consequently, the third to seventh bits VA3 to VA7 of the address signal to the VRAM 4 are outputted as they are to the 0th to fourth bits of the address signal to the TagRAM 5. Consequently, if rewriting occurs with the memory block 39 of the nth row of the 8ith column to the nth row of the 8i+7th column of the VRAM 4 in FIG. 6, then information of occurrence of rewriting is written into the memory element of the nth row of the ith column of the TagRAM 5.

On the other hand, where one line includes all pixels of one scanning line, all of the bits AS0 to AS4 of the address selection signal are set to "0" by the line size setting register 43. Consequently, the bits TA0 to TA4 of the address signal to the TagRAM 5 all become "0" irrespective of the values of the bits VA3 to VA7 of the address signal to the VRAM 4. Consequently, with whichever memory element of the memory block 40 of the kth row of the VRAM 4 in FIG. 6 rewriting occurs, information of the occurrence of rewriting is written into the memory cell of the kth row of the 0th column of the TagRAM 5. Consequently, since whether or not the pixels on the kth scanning line need be updated can be discriminated only by checking the memory cell 42 of the kth row of the 0th column of the TagRAM 5, the frequency of accessing to the TagRAM 5 is low. However, upon updating, all pixels on the one scanning line must be updated.

It is to be noted here that, while it is shown in FIGS. 5 and 6 for the convenience of illustration that a line of 32 pixels and another line of 1,024 pixels are present in a mixed condition, variation of the line size is performed on the time base, and actually, lines of different pixel numbers are not present at the same time. Consequently, if the pixel number of one line is set to m at a certain point of time, then m pixels form one line on the entire screen.

The size of one line can be set to 64 pixels, 128 pixels, 256 pixels or 512 pixels if the bits AS4 to AS0 are outputted as "11110b", "11100b", "11000b" or "10000b".

Figure 8:
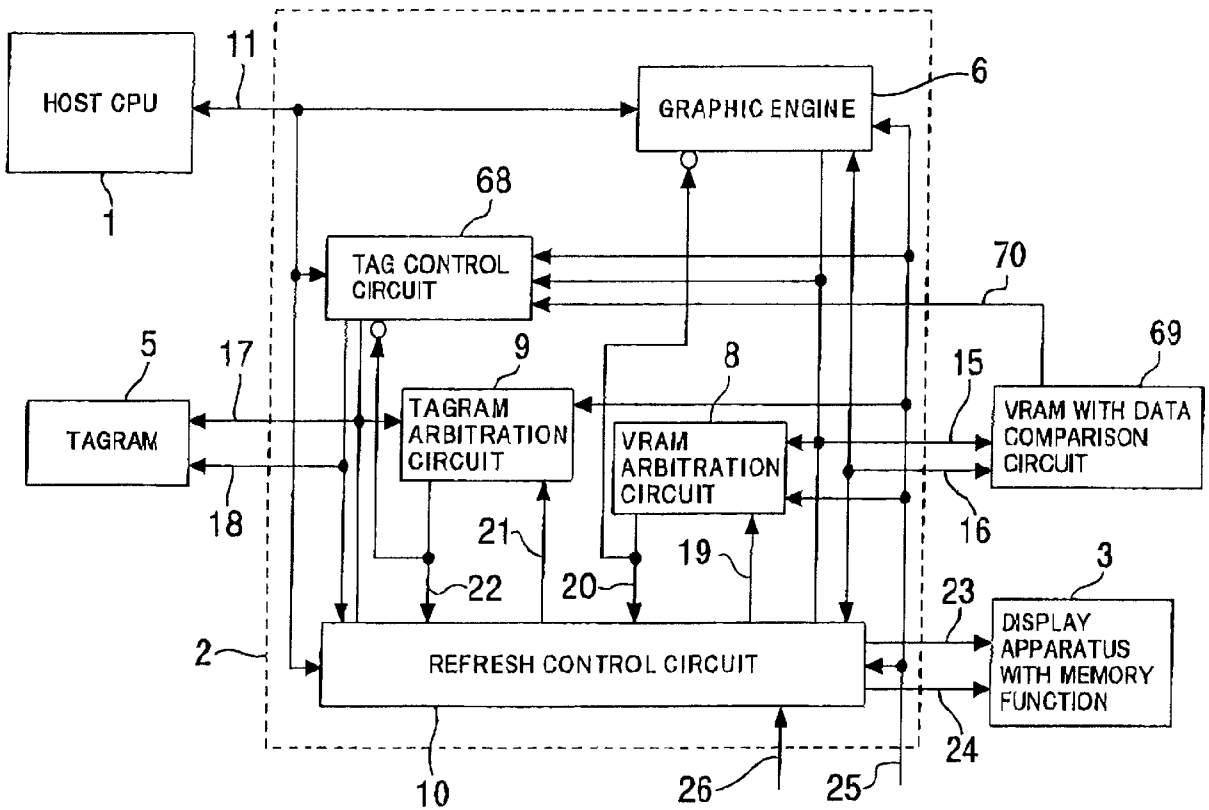
FIG. 8 is a block diagram of a system in which another display controller for a display apparatus having a memory function to which the present invention is applied is incorporated.

Referring now to FIG. 8 there is shown a system in which another display controller for a display apparatus having a memory function to which the present invention is applied is incorporated.

The system shown is a modification to and is different from the system described hereinabove with reference to FIG. 1 only in that it includes a Tag control circuit 68 in place of the rewriting detection circuit 7 of the system of FIG. 1 and includes a VRAM 69 with a data comparison circuit (the VRAM 69 is hereinafter referred to as comparison VRAM 69) in place of the VRAM 4 of the system of FIG. 1. Rewriting is detected by the comparison VRAM 69, and a result of the detection is transmitted to the Tag control circuit 68 using a comparison signal 70. The graphic engine 6 directly accesses the comparison VRAM 69 with a VRAM control signal set 15 and a VRAM data signal set 16. The Tag control circuit 68 produces a TagRAM control signal set 17 upon occurrence of rewriting of the comparison VRAM 69 based on the VRAM control signal set 15. A VRAM enabling signal 20 is inputted to the refresh control circuit 10 and the graphic engine 6.

Figure 9:
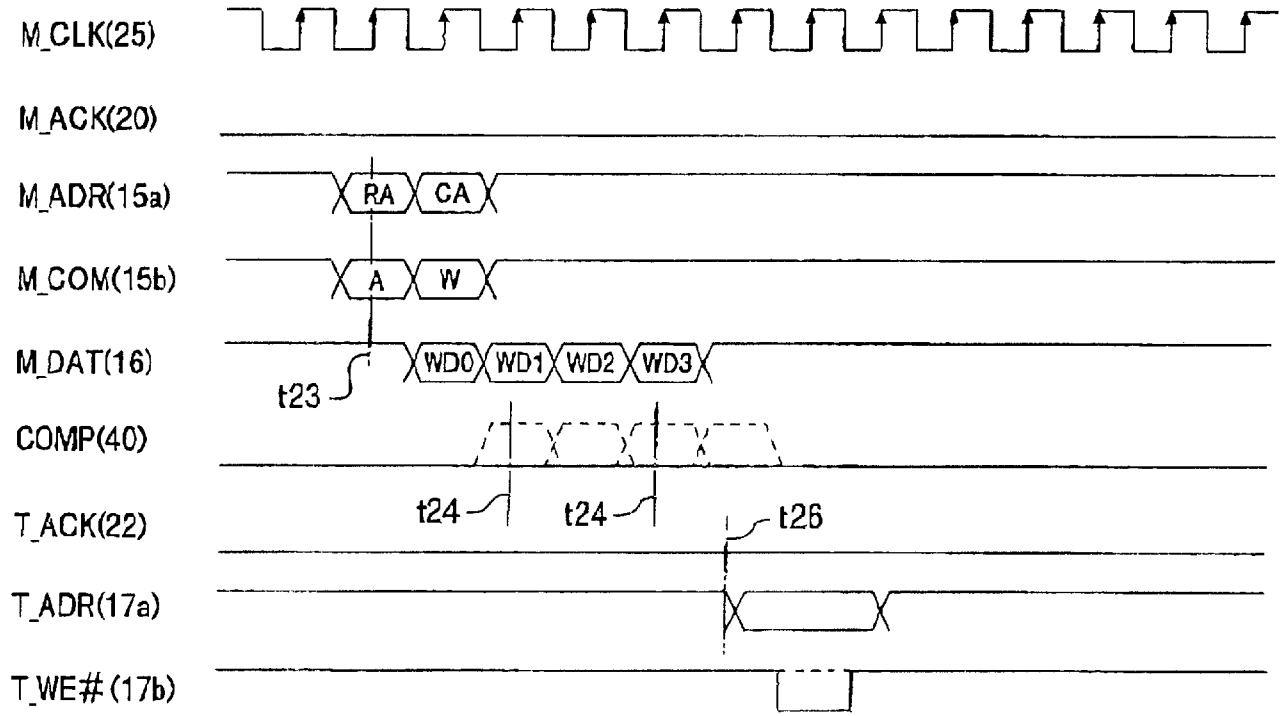
FIG. 9 is a timing chart illustrating operation when a graphic engine shown in FIG. 8 write accesses a comparison VRAM.

FIG. 9 is a timing chart illustrating operation when the graphic engine 6 of the system shown in FIG. 8 performs write accessing to the comparison VRAM 69. FIG. 9 corresponds to FIG. 6 which illustrates operation of the system of FIG. 1. Accessing is started at a timing t23 in FIG. 9, and data (WD0, WD1, WD2, WD3) are successively written into the comparison VRAM 69. A comparison signal 70 (COMP) is outputted after one clock interval from writing of each data (beginning with a timing t24).

For example, if the third data WD2 being to be written to the VRAM 4 is different from the data then placed in the VRAM 4, the signal COMP="1" is outputted at a timing t25 in FIG. 9. The Tag control circuit 68 receives the signal and starts writing of rewriting information into the TagRAM 5 (at a timing t26). An address signal 17*a* (T_ADR) to the TagRAM 5 at this time is produced by the Tag control circuit 68 based on an address signal 15*a* (M_ADR) to the VRAM 4.

The host CPU 1, display apparatus 3, TagRAM 5, graphic engine 6, VRAM arbitration circuit 8, TagRAM arbitration circuit 9 and refresh control circuit 10 operate similarly as in the system of FIG. 1 described hereinabove.

The comparison VRAM 69 compares, upon write accessing thereto, write data and data currently stored therein with each other and outputs a result of the comparison as a comparison signal. The following description is given taking a DRAM (Dynamic Random Access Memory), which is commonly used as a VRAM, as an example.

Figure 10:
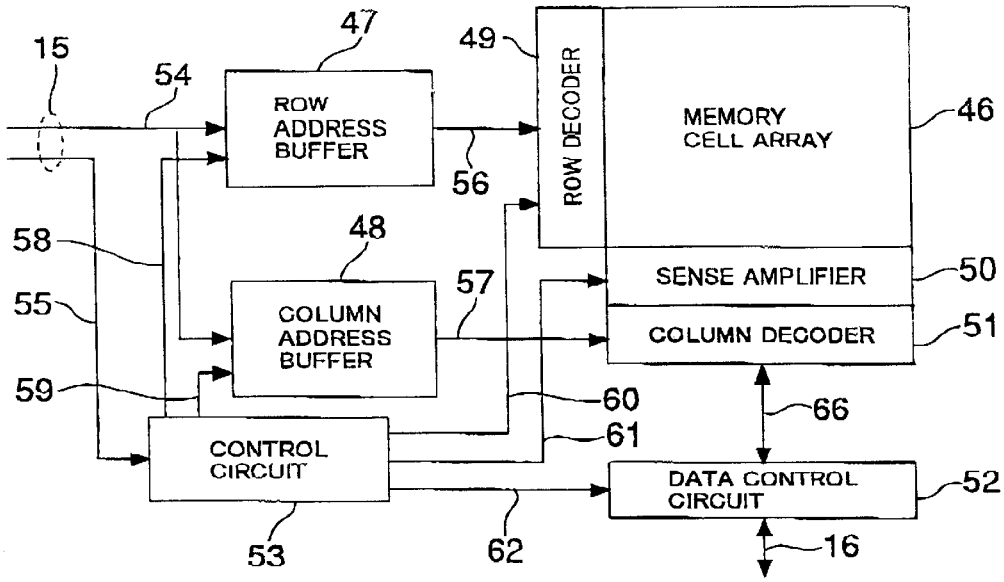
FIG. 10 is a block diagram showing a construction of a common DRAM.

FIG. 10 shows a construction of a popular DRAM. The DRAM shown includes a memory cell array 46 for storing data, a row address buffer 47 for producing a row address 56 from an address signal 54 and latching it, a column address buffer 48 for producing a column address 57 from the address signal 54 and latching it, a row decoder 49 for selecting a word line from the row address and driving it, a sense amplifier 50 for amplifying an output of the memory cell array 46, a column decoder 51 for outputting only a bit line selected by the column address 57 to the data control circuit 52, a data control circuit 52 for controlling inputting/outputting of data, and a control circuit 53 for controlling the entire DRAM.

Figure 11:
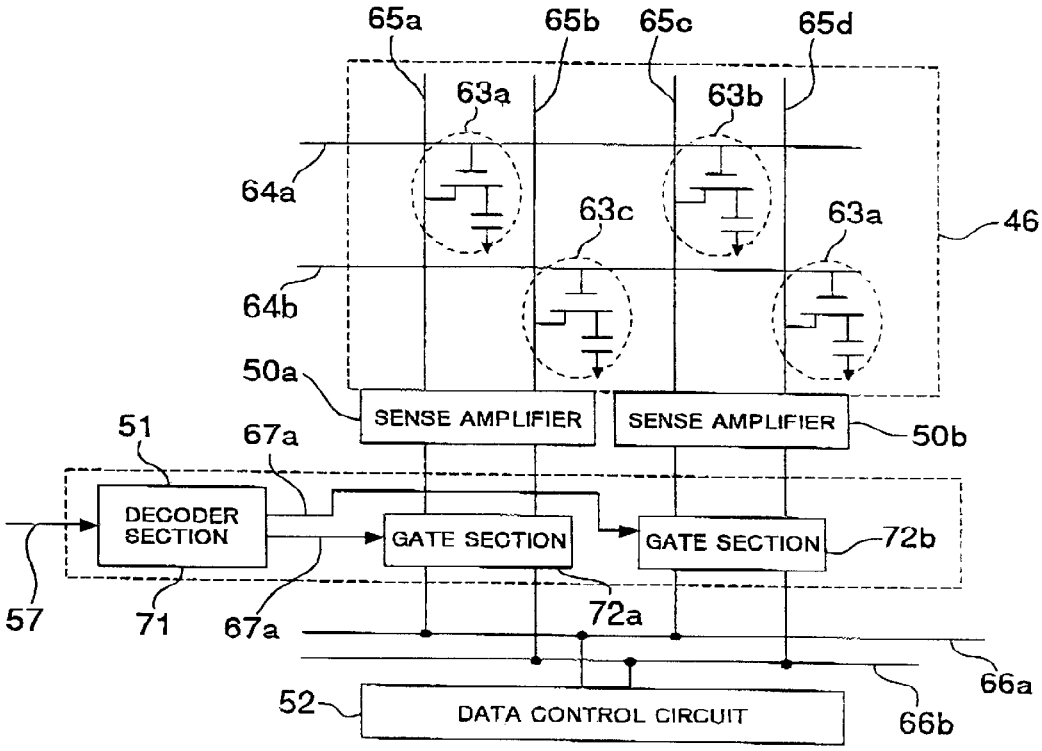
FIG. 11 is a diagrammatic view particularly showing part of a memory cell array, a sense amplifier, a column decoder and a data control circuit shown in FIG. 10.

FIG. 11 particularly shows part of the memory cell array 46, sense amplifier 50, column decoder 51 and data control circuit 52. The memory cell array 46 is composed of word lines 64, bit lines 65 and memory cells 63 disposed at crossing points of the word lines 64 and the bit lines 65.

Figure 17:
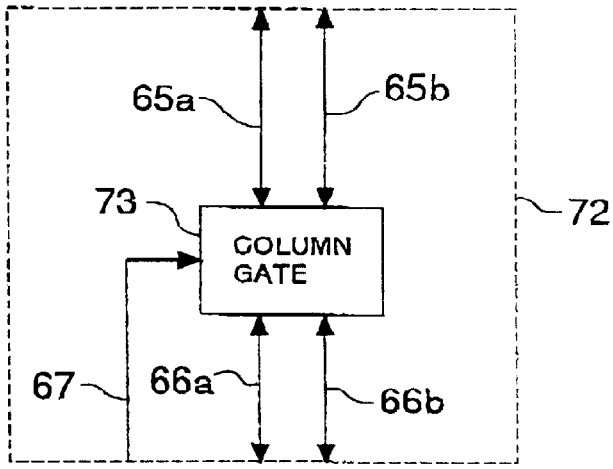
FIG. 17 is a diagrammatic view showing a construction of a gate section of the column decoder shown in FIG. 10.

The column decoder 51 includes a decoder section 71 and a number of gate sections 72 equal to the number of columns. The decoder section 71 produces and supplies column selection signals 67 to the gate sections 72. A set of two bit lines 65 extend through each of the sense amplifiers 50 and are connected to one of the gate sections 72 of the column decoder 51. The bit lines 65 are collectively connected to two lines, that is, two local data buses 66, at the exits of the gate sections 72. The local data buses 66 are connected to the data control circuit 52. The gate sections 72 of the column decoder 51 have such a structure as shown in FIG. 17. Referring to FIG. 17, each of the gate sections 72 includes a column gate 73 for controlling conducting/non-conducting of two bit lines 65 and the local data buses 66 in response to a column selection signal 67.

Figure 18:
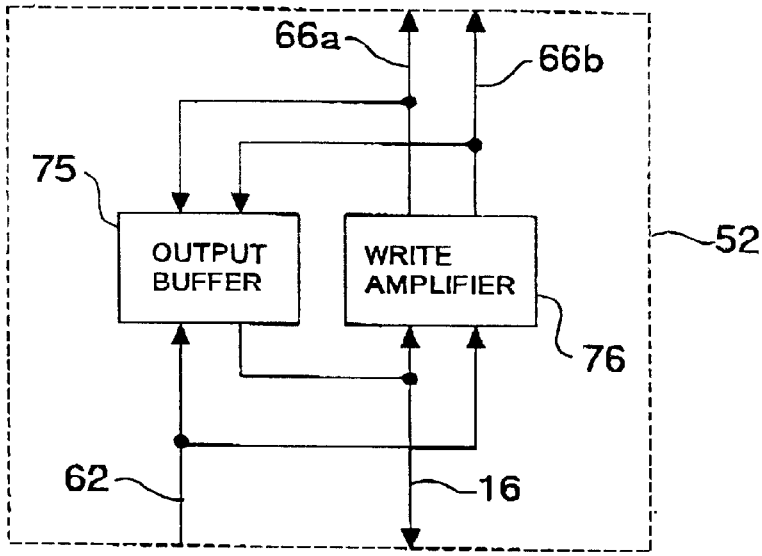
FIG. 18 is a diagrammatic view showing a construction of the data control circuit shown in FIG. 10.
Figure 19:
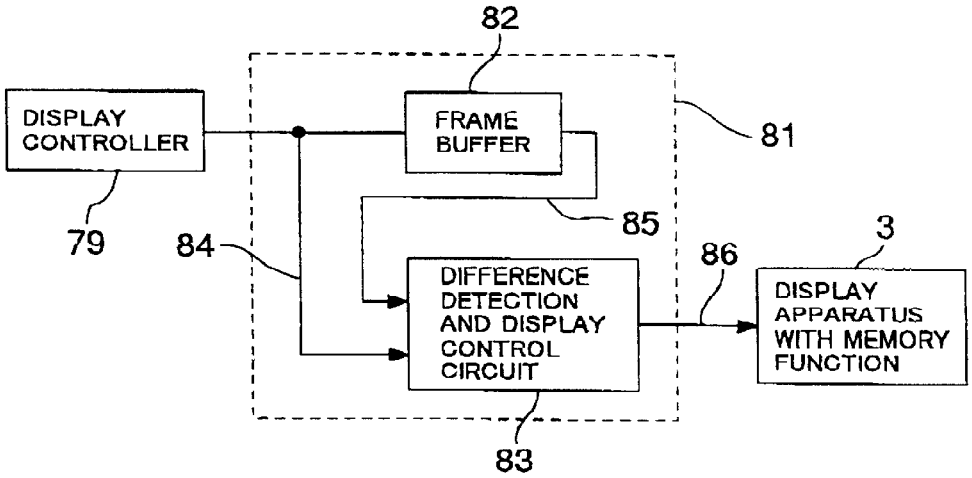
FIG.19 PRIOR ART
FIG. 19 is a block diagram showing a conventional system wherein display data outputted from a conventional display controller having no rewriting detection function is passed once through a display conversion apparatus having a writing detection function to drive a display apparatus having a memory function.
Figure 20:
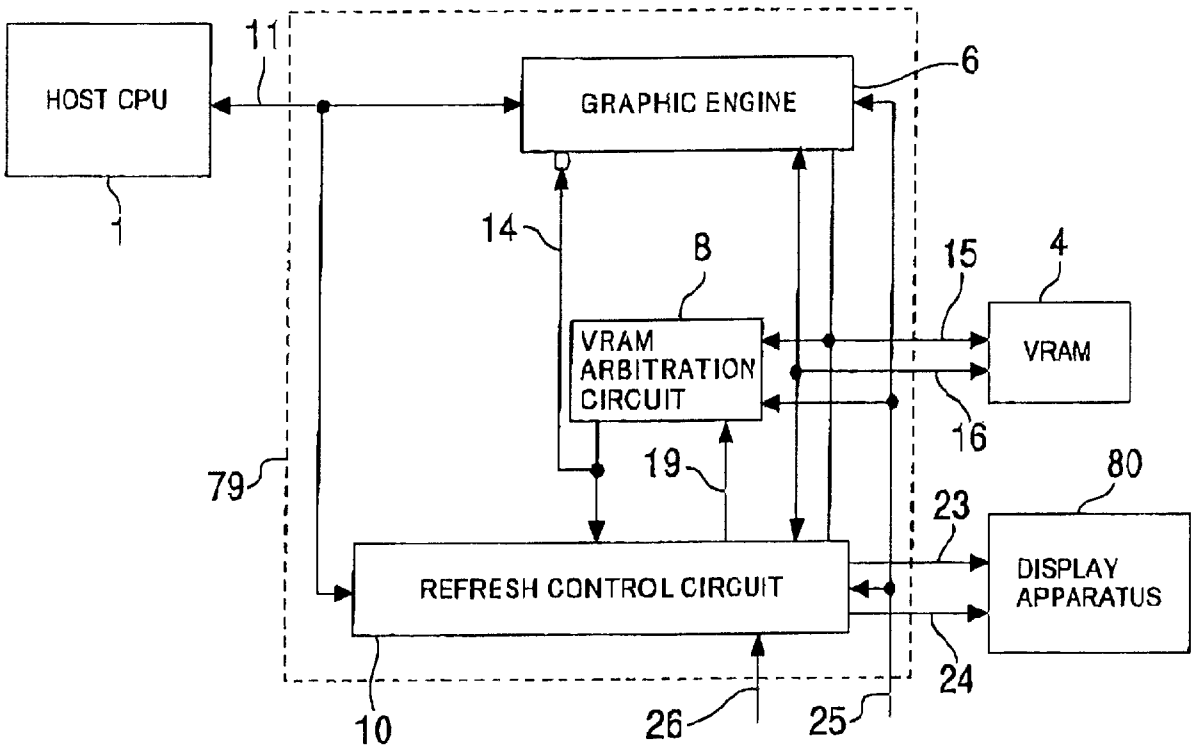
FIG.20 PRIOR ART
FIG. 20 is a block diagram showing a conventional display controller and associated circuits therearound.
Figure 21:
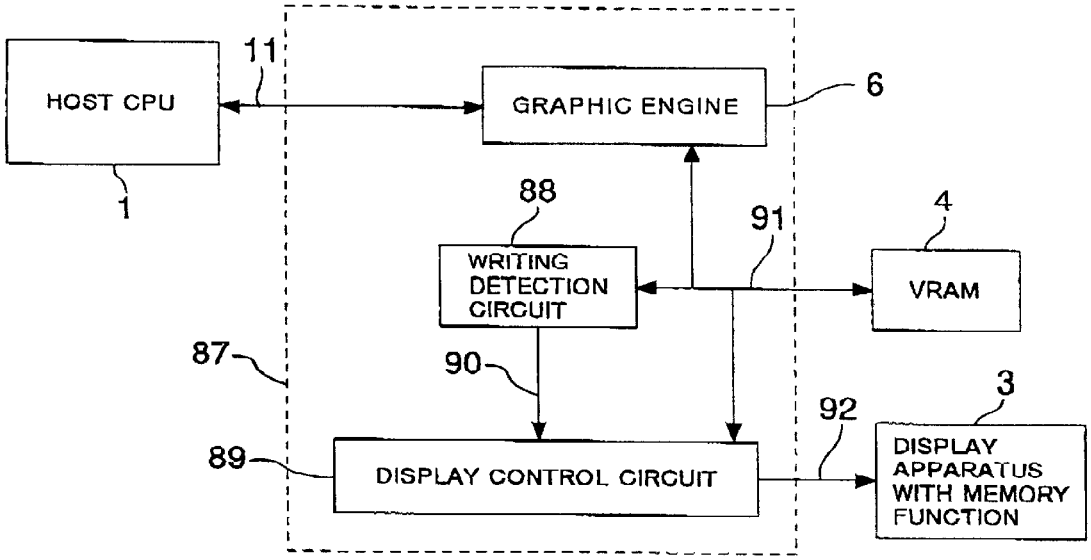
FIG.21 PRIOR ART
FIG. 21 is a block diagram of another conventional system wherein a display controller has a function of detecting write accessing to a VRAM of a graphic engine.

The data control circuit 52 has such a structure as shown in FIG. 18. Referring to FIG. 18, upon writing, a data signal 16 inputted from the outside is converted into a signal of an internal signal level by a write amplifier 76, and the resulting signal is outputted to the local data buses 66. Upon reading out, a signal of the local data buses 66 is converted into a signal of an external signal level by an output buffer 75, and the resulting signal is outputted to the data signal 16. Which one of the operations should be performed is controlled with a write/read selection signal 62.

Figure 12:
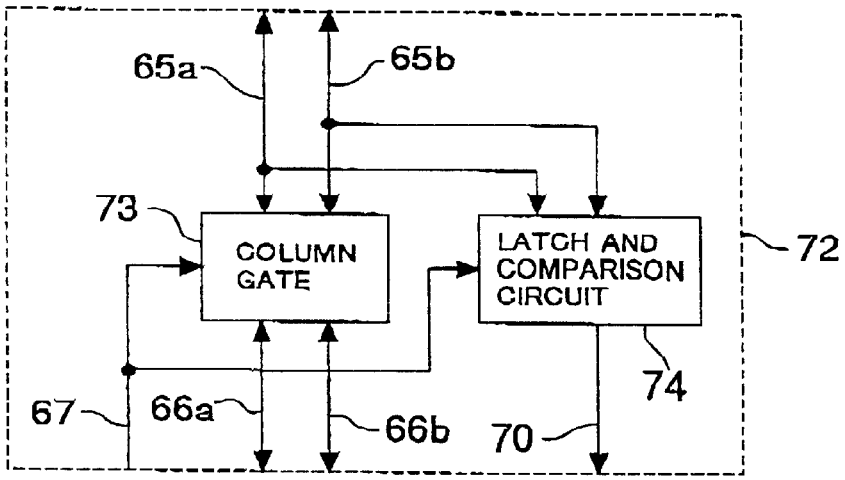
FIG. 12 is a block diagram showing a first form of the comparison VRAM shown in FIG. 8.
Figure 13:
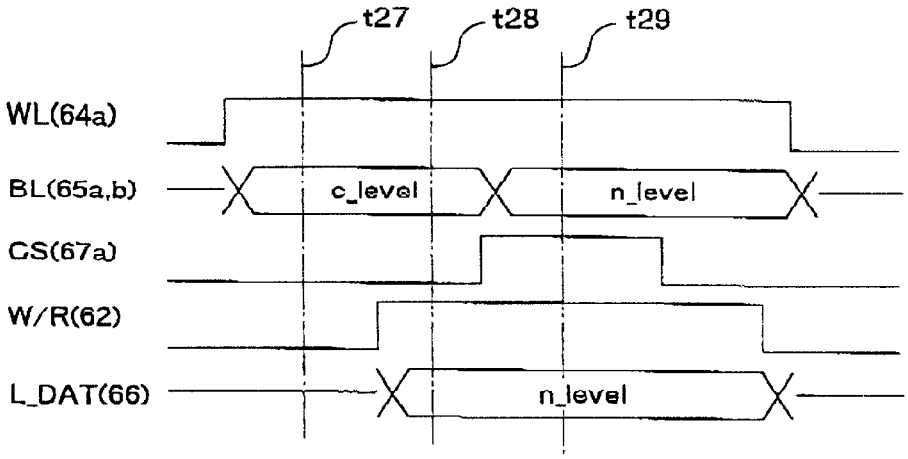
FIG. 13 is a timing chart illustrating operation of the comparison VRAM of FIG. 12.

The comparison VRAM 69 in the system shown in FIG. 8 may be implemented in two different forms. FIG. 12 shows a first one of the forms. Referring to FIG. 12, in the first form shown, the gate sections 72 of the column decoder 51 have the function of the comparison VRAM 69. A latch and comparison circuit 74 is placed for each of the gate sections 72, and a pair of bit lines 65 are inputted to the latch and comparison circuit 74 and a comparison signal 70 is outputted from the gate section 72. Operation of the latch and comparison circuit 74 is controlled with a column selection signal 67. FIG. 13 is a timing chart illustrating operation of the circuit of FIG. 12. Referring to FIG. 13, reference character WL denotes a signal of a word line 64, BL a signal of a bit line 65, CS a column selection signal 67, W/R a write/read selection signal 62, and L_DAT a signal of the local data buses 66. Operation of the circuit shown in FIG. 12 is described with reference to FIGS. 12, 13 and 11.

If the potential of a certain word line 64*a* becomes an active potential, then storage potentials of the memory cells 68*a* and 63*b* connected to the word line 64*a* appear on the bit lines 65*a* and 65*c*. This state can be indicated at a timing t27 of FIG. 13. Reference character c_level represents the current storage potential. On the other hand, if the signal W/R becomes W/R="1", then a potential corresponding to inputted data is outputted to the local data buses 66. This state is indicated at a timing t28.

Reference character n_level represents a potential to be stored next. Then, if the potential of the column selection signal 67*a* becomes an active potential, then the local data buses 66*a* and 66*b* and the bit lines 65*a* and 65*b* are rendered conducting. Consequently, the potential n_level is driven by the bit lines 65*a* and 65*b* and held by the memory cell 63*a* whose word lines are in an active state (at a timing t29). In this manner, on the bit lines 65*a* and 65*b*, the current storage potential c_level appears first, and then the new storage is potential n_level appears.

Thus, the potential latched at a rising edge of the column selection signal 67 and the potential appearing on the bit lines 65*a* and 65*b* at a falling edge of the column selection signal 67 are compared with each other. If the potentials exhibit different levels from each other, then "1" is outputted to the comparison signal 70. It is to be noted that the comparison signal 70 is a logical AND of all of the data bits of all of the columns. This method utilizes the fact that, when a word line becomes active, a current storage potential appears on a bit line, and has an advantage that it operates at an operation timing similar to that of a conventional DRAM and has no penalty with regard to the operation speed. However, the method is disadvantageous in that a large circuit scale is required because a comparison circuit is required for each one of gate sections of a column decoder, that is, a number of comparison circuits equal to the number of columns are required.

The second form is constructed such that the latch and comparison circuit 74 is placed in the data control circuit 52 and thus utilizes the fact that, when the write amplifier 76 is in an inoperative state, the potential of the bit lines 65 selected with a column selection signal 67 appears on the local data buses 66.

Figure 14:
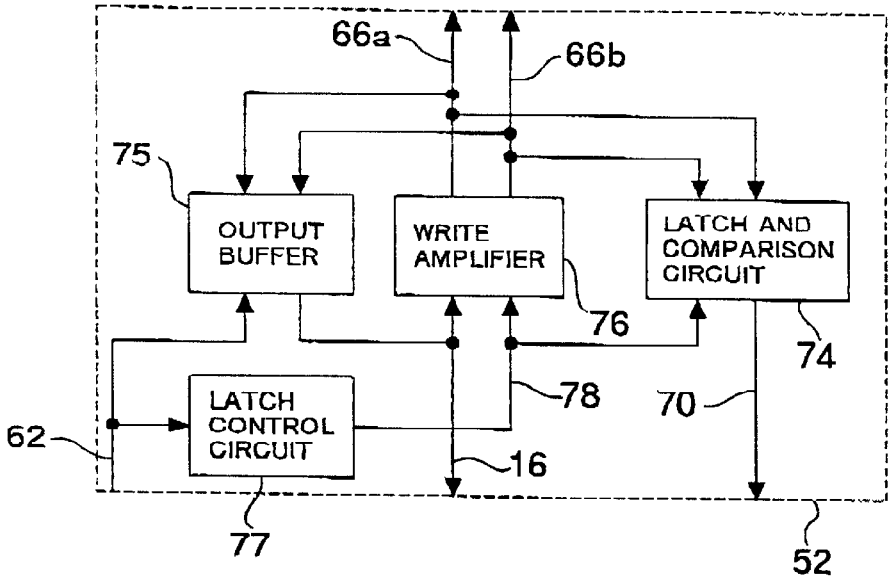
FIG. 14 is a block diagram showing a construction of a data control circuit used in a second form of the comparison VRAM shown in FIG. 8.

FIG. 14 shows a construction of the data control circuit 52 employed in the second form. Referring to FIG. 14, the data control circuit 52 shown is different from the data control circuit 52 shown in FIG. 18 in that it additionally includes a latch and comparison circuit 74 for latching and comparing a potential of the local data buses 66, and a latch control circuit 77 for producing a write enabling signal 78 for controlling the latch and comparison circuit 74 and the write amplifier 76 from the write/read selection signal 62.

Figure 16:
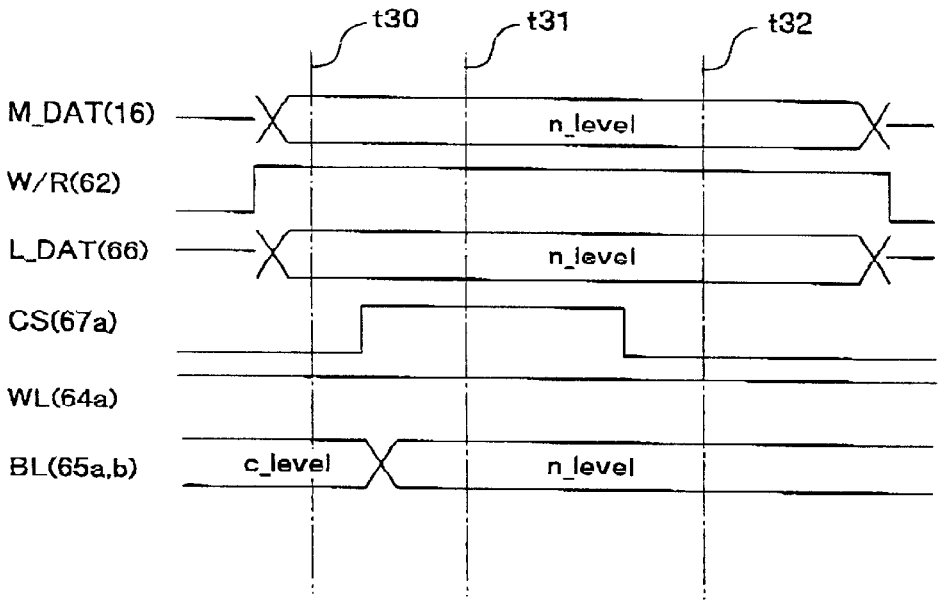
FIG. 16 is a timing chart illustrating operation of the data control circuit of FIG. 14 upon early writing.

FIG. 16 illustrates operation of a conventional data control circuit upon early writing which is common as writing operation into a DEM. If the W/R signal changes to W/R="1" which indicates writing, then the write amplifier 76 drives the local data bus (L_DAT) with a potential (n_level) corresponding to input data (M_DAT) (at a timing t30). Since, at the timing t30, the word line 64*a* corresponding to an address into which the data is to be written is active (WL="1") and the column selection signal 67*a* is inactive (CS="0"), a current holding potential (n_level) appears on the bit lines 65*a* and 65*b*. Then, if the column selection signal 67*a* corresponding to another address into which data is to be written becomes active (CS="1") at another timing t31, then a new holding potential (n_level) is driven on the bit lines 65*a* and 65*b* and stored into a memory cell. Consequently, even if the column selection signal 67*a* thereafter becomes inactive (CS="0"), the bit lines 65*a* and 65*b* keep the n_level.

Figure 15:
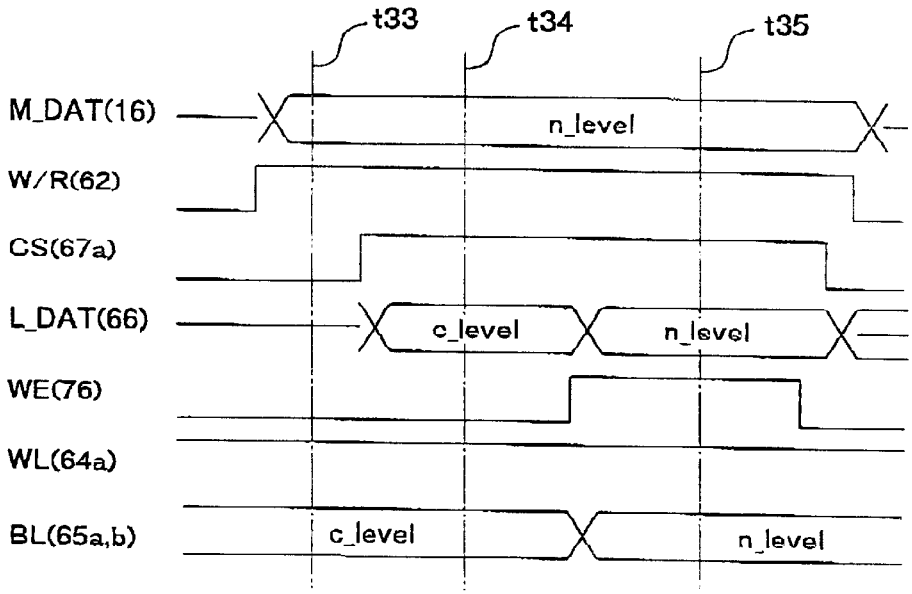
FIG. 15 is a timing chart illustrating operation the data control circuit of FIG. 14 upon writing.

FIG. 15 illustrates operation upon writing where the second form described hereinabove with reference to FIG. 14 is used.

First at a timing t33, since the write enabling signal 78 which is an operation control signal for the write amplifier 76 is still inactive (WE="0") different from that at the timing t30 of FIG. 15, the local data buses 66 have a precharge level. On the other hand, since the word line 64*a* is active similarly as in the case of FIG. 15, the bit lines 65*a* and 65*b* have a current holding potential. If the column selection signal 67*a* becomes active at another timing t34, then the current holding potential appears on the local data buses 66. Then, if the write amplifier 76 becomes active at a further timing t35, then the local data buses 66 and the bit lines 65*a* and 65*b* are driven with a new holding potential.

In short, in the present second form, a late writing timing is produced internally. Consequently, since a current holding potential appears at the timing t34 and a new holding potential appears at the timing t35 on the local data buses 66, the latch control circuit 77 compares the two holding potentials and outputs a result of the comparison as a comparison signal 70. The points of an object of comparison are a rising edge and a falling edge of the write amplifier 76. It is to be noted that the comparison signal 70 is a logical AND of all data bits. The present second method requires only a number of latch and comparison circuits equal to the number of data signals and is advantageous in that, when compared with the first method, the required number of latch and comparison circuits is reduced to one nth where n is the number of columns. However, since the present second method involves conversion of timings, there is the possibility that it may restrict an increase of the speed of operation of the DRAM itself.

While the display controller for a display apparatus having a memory function described hereinabove with reference to FIG. 1 has the possibility that it may be less advantageous in performance in that the number of reading accessing operations (cycle beginning with the timing t10) with respect to write accessing of the graphic engine is greater than ever, the display controller for a display apparatus having a memory function described hereinabove with reference to FIG. 8 can eliminate such unnecessary reading accessing operations while the writing accessing cycle of the graphic engine is similar to that in a conventional controller.

While preferred embodiments of the present invention have been described using specific terms, such description is for illustrative purposes only, and it is to be understood that changes and variations may be made without departing from the spirit or scope of the following claims.

What is claimed is:

1. A display controller for controlling a display apparatus having a memory function, comprising:

display updating means for updating a display of said display apparatus;

display data storage means;

display data production means for producing and writing display data into said display data storage means;

rewriting comparison means for detecting by comparison whether or not rewriting of data in a line, which is a set of pixels including a certain number of successive pixels on one scanning line of said display apparatus and is used as a unit of comparison, into said display data storage means has occurred;

rewriting information storage means for storing comparison information of a result of the comparison of said rewriting comparison means into a corresponding address thereof;

rewriting control means for checking, prior to updating of the display by said display updating means, the address of said rewriting information storage means and, only when stored contents of the address represent rewriting of different data, reading the data from said display data storage means and signaling the data to said display apparatus through said display updating means; and line size variation means for varying the number of pixels which form a line as the unit of rewriting comparison, wherein the line size variation means varies the number of pixels which form a line at a time point between two adjacent refresh cycles of the display.

2. A display controller as claimed in claim 1, wherein said display data storage means includes said rewriting comparison means for detecting by comparison whether or not rewriting to different data has occurred.

3. A display controller as claimed in claim 2, wherein said rewriting comparison means latches and compares potentials to detect whether or not rewriting to different data has occurred.

4. A display controller as claimed in claim 3, further comprising arbitration means for arbitrating accessing to said display data storage means from said rewriting comparison means and from said rewriting control means and for arbitrating accessing to said rewriting information storage means from said rewriting comparison means and said rewriting control means.

5. A display controller as claimed in claim 2, further comprising arbitration means for arbitrating accessing to said display data storage means from said rewriting comparison means and from said rewriting control means and for arbitrating accessing to said rewriting information storage means from said rewriting comparison means and said rewriting control means.

6. A display controller as claimed in claim 1, further comprising arbitration means for arbitrating accessing to said display data storage means from said rewriting comparison means and from said rewriting control means and for arbitrating accessing to said rewriting information storage means from said rewriting comparison means and said rewriting control means.

7. A display controller as claimed in claim, 1, wherein the number of pixels which form a line is changed based on one of: a) hardware, and b) a software instruction provided to the display data storage means.

8. A display controller for controlling a display apparatus having a memory function, comprising:

display updating means for updating a display of said display apparatus;

display data storage means;

display data production means for producing and writing display data into said display data storage means;

rewriting comparison means for detecting by comparison whether or not rewriting of data in a line, which is a set of pixels including a certain number of successive pixels on one scanning line of said display apparatus and is used as a unit of comparison, into said display data storage means has occurred;

rewriting information storage means for storing comparison information of a result of the comparison of said rewriting comparison means into a corresponding address thereof;

rewriting control means for checking, prior to updating of the display by said display updating means, the address of said rewriting information storage means and, only when stored contents of the address represent rewriting of different data, reading the data from said display data storage means and signaling the data to said display apparatus through said display updating means;

arbitration means for arbitrating accessing to said display data storage means from said rewriting comparison means and from said rewriting control means and for arbitrating accessing to said rewriting information storage means from said rewriting comparison means and said rewriting control means; and line size variation means for varying the number of pixels which form a line as the unit of rewriting comparison, wherein said display data storage means includes said rewriting comparison means for detecting by comparison whether or not rewriting to different data has occurred, wherein said rewriting comparison means latches and compares potentials to detect whether or not rewriting to different data has occurred, and wherein the line size variation means varies the number of pixels which form a line at a time point between two adjacent refresh cycles of the display.

9. A display controller as claimed in claim, 8, wherein the number of pixels which form a line is changed based on one of: a) hardware, and b) a software instruction provided to the display data storage means.

* * * * *